United States Patent [19]

Aoyagi et al.

[11] Patent Number: 4,727,055

[45] Date of Patent: Feb. 23, 1988

[54] HEAT-SENSITIVE RECORD MATERIAL AND PROCESS FOR THE PRODUCTION THEREOF

[75] Inventors: Shoji Aoyagi, Suita; Hideaki Suzuki; Shuichiro Takeda, both of Nishinomiya, all of Japan

[73] Assignee: Kanzaki Paper Manufacturing Co., Ltd., Tokyo, Japan

[21] Appl. No.: 777,525

[22] Filed: Sep. 19, 1985

[30] Foreign Application Priority Data

Sep. 20, 1984 [JP] Japan ..... 59-199243

[51] Int. Cl.[4] ..... B41M 5/18

[52] U.S. Cl. ..... 503/214; 427/152; 503/200; 503/226

[58] Field of Search ..... 346/200, 226; 427/150–152; 503/200, 214, 226

[56] References Cited

U.S. PATENT DOCUMENTS 4,370,370 1/1983 Iwata et al. ..... 346/226
4,388,362 6/1983 Iwata et al. ..... 346/226

FOREIGN PATENT DOCUMENTS 0191189 11/1983 Japan ..... 346/200

*Primary Examiner*—Bruce H. Hess
*Attorney, Agent, or Firm*—Wenderoth, Lind & Ponack

[57] ABSTRACT

A heat-sensitive record material having a thick base support consisting of at least two base sheets and at least one binder layer, said base support weighing at least 150 g/m$^2$ and having an excellent dimensional stability without accompaniment of any cockles and any background fogginess. It is particularly suitable for use in providing tags, tickets, cards, price marks etc. A process for the production of said heat-sensitive record material by the use of a binder consisting essentially of at least one thermoplastic polymer for which the vicat softening temperature is 20° C. to 180° C. and preferably 30° C. to 160° C.

5 Claims, 2 Drawing Figures

HEAT-SENSITIVE RECORD MATERIAL AND PROCESS FOR THE PRODUCTION THEREOF

FIELD OF THE INVENTION

This invention relates to a heat-sensitive record material having a thick base support and to a process for producing the same. More particularly, it relates to a heat-sensitive record material having a thick base support with a basis weight of 150 g/m$^2$ or more and to a process for producing the same using as a binder one or more thermoplastic polymers for which the vicat softening temperature is 20° C. to 180° C.

BACKGROUND OF THE INVENTION

As is well known, heat-sensitive record material generates a colored image by thermally bringing a color former into contact with a color developer, which then developes a color. An advantage of the heat-sensitive record material is that it provides fairly easy maintenance of the recording apparatus. Such materials are now widely used as a recording medium for facsimiles, computer printers and measuring instrument printers.

Known heat-sensitive record materials are mostly those having as a base support sheet materials weighing less 150 g/m$^2$. This is due to the fact that a heat-sensitive record material in which the base support weighs 150 g/m$^2$ or more is difficult to stably manufacture, because of problems which can not be easily resolved in the process such as limited fitness of the coating apparatus to be used and the occurrence of curls in the base sheet. In particular, it is difficult to obtain even coating of the surface in the application of the heat-sensitive coating composition onto the base sheet with a bar coater, blade coater, air-knife coater etc. due to the fact that the greater the basis weight of the base sheet becomes the more the contact profile between coater head of the apparatus and the base sheet becomes uneven. In addition, with increases in the basis weight of the base sheet to be used, curls become apt to occur in the assembly obtained.

And, even if a heat-sensitive record material having a thick base sheet of 150 g/m$^2$ or more could be obtained, it has a tendency to curl during storage or otherwise during the printing operation of facsimile, computer printer, etc.

On the other hand, there is now an increased demand for thick heat-sensitive record materials in various fields and such thick materials particularly usable for tags, tickets, cards, price marks etc.

SUMMARY OF THE INVENTION

In extensive studies to develop a practical process for stably producing a heat-sensitive record material having a base support of 150 g/m$^2$ or more which is usable, for example, for tags, tickets, cards, price marks etc., and without problems such as occur in the known process, the present inventors have attempted to adhere together two or more paper sheets which results in making the total basis weight of the base support 150 g/m$^2$ or more. This unitary structure is employed as a support base, and a heat-sensitive record layer containing a color forming material and a color developing material which undergoes a color forming reaction on contact with the color forming material is applied over the base support. As a result, the present inventors have found that said method makes it possible to provide a thick heat-sensitive record material. However, this basis method is accompanied with problems in that the moisture contained in the binder in a large amount often makes paper sheets expand and/or contract thereby inviting the occurrence of cockles thereon. Also the organic solvent contained in the binder in a large amount, being quite sensitive with the heat-sensitive record layer, sometimes causes a so-called background fogginess which results in unexpected color development, so that the heat-sensitive record material becomes unusable for tags, tickets, cards, price marks etc.

The inventors in successive intensive studies have found that when a binder containing a thermoplastic polymer having a vicat softening point of less 180° C. is used, the above problems may be effectively eliminated and a desirable thick heat-sensitive record material is obtained. On the basis of these findings, the inventors have completed this invention.

One object of this invention is to provide a desirable heat-sensitive record material having a thick base support consisting of two or more base sheets and one or more binder layers, the base support weighing at least 150 g/m$^2$ and having an excellent dimensional stability without the accompaniment of any cockles and any background fogginess.

Another object of this invention to provide said desirable heat-sensitive record material particularly suitable for use in providing tags, tickets, cards, price marks etc.

A further object of this invention is to provide a process for producing the foregoing desirable heat-sensitive record material using a binder consisting essentially of one or more thermoplastic polymers for which the vicat softening temperature is 20° C. to 180° C.

The nature, utility, and further features of this invention will be more clearly apparent from the following detailed description with a consideration of general aspects of the invention and concluding with specific examples for the practice thereof as well as certain comparison examples.

DETAILED DESCRIPTION OF THE INVENTION

The process for producing a heat-sensitive record material having a thick base support which consists two or more base sheets which are welded together making the base support 150 g/m$^2$ or more is characterized in that one or more base sheets are welded to a master base sheet which has a heat-sensitive record layer coated thereon, the welding being achieved by heat-fusion adhesion of a binder consisting essentially of a thermoplastic polymer for which the vicat softening temperature is in the range of between 20° C. and 180° C. and preferably between 30° C. and 160° C.

Figure 1:
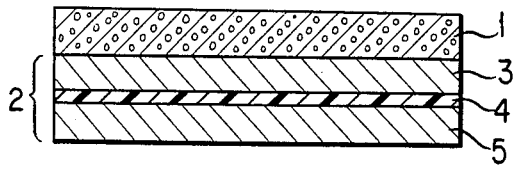
FIGS. 1 and 2 are cross-sections taken in planes lying in the direction of the thickness of respective heat-sensitive record material of this invention.
Figure 2:
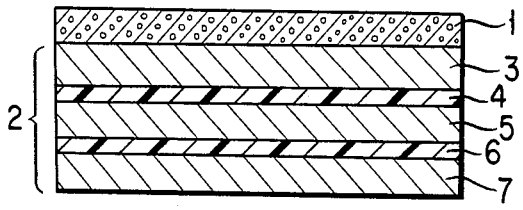

A typical form of the assembly of the heat-sensitive record material provided according to the process of this invention is as illustrated either in FIG. 1 or in FIG. 2 in which 1 represents the heat-sensitive record layer, which layer contains a color forming material and a color developing material and which undergoes a color forming reaction on contact with the color forming materials. Such layer is formed over the base support 2 having a basis weight of 150 g/m$^2$ or more and which comprises two or more base sheets and one or more binder layers.

FIG. 1 illustrates an example of the heat-sensitive record material provided according to this invention which has two base sheets namely master base sheet 3 over which heat-sensitive record layer 1 is formed and second base sheet 5 which is adhered to the master base sheet with the binder which forms binder layer 4. FIG. 2 illustrates likewise another example of the heat-sensitive record material provided according to this invention and which has three base sheets namely master base sheet 3, second base sheet 5 and third base sheet 7 and two binder layers, namely first binder layer 4 and second binder layer 6.

As the base sheet to be employed in this invention, any of the known sheets are usable.

Examples of such sheets are paper, art paper, coated paper, cellophane, synthetic resin film, synthetic fiber sheet, plastic laminated paper, non-woven sheet, foil paper etc.

The manner of forming heat-sensitive record layer 1 over master base sheet 3 is not particularly limited, but can be any of the conventional methods. For example, a heat-sensitive coating composition is applied to the master base sheet by air knife coating or blade coating and then dried. The amount of the coating composition is also not particularly limited but is generally about 2 to about 12 $g/m^2$, preferably about 3 to about 10 $g/m^2$, based on dry weight.

Color forming materials and color developing materials useful for the heat-sensitive record layer are known. These can be, for example, the combination of a colorless or pale-colored basic dye and an inorganic or organic acidic material, and the combination of ferric stearate of like metallic salt of higher fatty acid and gallic acid or like phenol.

Examples of useful colorless or pale-colored basic dyes are those already known and include:

Triarylmethane-based dyes, e.g., 3,3-bis(p-dimethylaminophenyl) -6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-2-yl)-phthalide, 3,3-bis(1,2-dimethylindole-3yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylamino-benzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylf 3-(N-ethyl-p-toluidino)-7-methylfluoran, 3-diethylamino-7-(N-acetyl-N-methylamino)-fluoran, 3-diethylamino-73-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamylamino)-6-methyl-7-phenylaminofluoran; 3(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)-fluoran, 3-pyrrolidino-6-methyl-7-p-butylphenylaminofluoran, etc.

Examples of inorganic or organic acidic materials which undergo a color forming reaction with such basic dyes on contact therewith are those already known, such as inorganic acidic materials including activated clay, acidic clay, attapulgite, bentonite, colloidal silica and aluminum silicate; and organic acidic materials including phenolic compounds such as 4-tert-butylphenol, 4-tert-octylphenol, 4-phenylphenol, 4-acetylphenol, α-naphthol, β-naphthol, hydroquinone, 2,2'-dihydroxydiphenyl, 2,2'-methylenebis-(4-methyl-6-tert-butylphenol), 2,2'-methylenebis-(4-chlorophenol), 4,4'-dihydroxydiphenylmethane, 4,4'-isopropylidenediphenol, 4,4'-isopropylidene-bis(2-tert-butylphenol), 4,4'-sec-butylidenediphenol, 4,4 4,4'-dihydroxydiphenyl sulfide, 4,4'-thiobis (6-tert-butyl-3-methylphenol), 4,4'-dihydroxydiphenyl sulfone, 4-hydroxybenzoic acid benzylester, 4-hydroxyphthalic acid dimethylester, hydroquinone monobenzyl ether, novolak phenol resins and phenolic polymers: aromatic carboxylic acids such as benzoic acid, p-tert-butylbenzoic acid, trichlorobenzoic acid, 3-sec-butyl-4-hydroxybenzoic acid, 3-cyclohexyl-4-hydroxybenzoic acid, 3,5-dimethyl-4-hydroxybenzoic salicylic acid, 3-isopropylsalicylic acid, 3-tert-butylsalicylic acid, 3-benzylsalicylic acid, 3-(α-methylbenzyl)-salicylic acid, 3-chloro-6-(α-methylbenzyl)-salicylic acid, 3,5-di-tertbutylsalicylic acid, 3-phenyl-5-(α,α-dimethylbenzyl)-salicylic acid, 3,5-di-(α-methylbenzyl)-salicylic acid and terephthalic acid: also, salts of such phenolic compounds or aromatic carboxylic acids with polyvalent metals such as zinc, magnesium, aluminum, calcium, titanium, manganese, tin and nickel.

For the preparation of the heat-sensitive record material of the present invention, the proportions of the color forming material and the color developing material to be incorporated into the record layer are suitably determined according to the kinds of these materials and are not particularly limited. For example, when the combination of a colorless or pale-colored basic dye and an inorganic or organic acidic material is used, 1 to 50 parts by weight, preferably 2 to 10 parts by weight, of the acidic material is used per part by weight of the dye.

These materials are formulated into a heat-sensitive coating composition generally with use of water as a dispersion medium and a stirring or pulverizing device, such as a ball mill, attritor or sand mill, by dispersing the two materials at the same time or separately. Usually the coating composition has incorporated therein a binder, such as starches, hydroxyethyl cellulose, methyl cellulose, carboxymethyl cellulose, gelatin, casein, gum arabic, polyvinyl alcohols, styrene-maleic anhydride copolymer salt, styrene-acrylic acid copolymer salt, styrene-butadiene copolymer emulsion or the like. The binder is used in an amount of about 5 to about 40% by weight, preferably about 10 to about 30% by weight, based on the total solids content of the composition.

Various auxiliary agents can be further admixed with the heat-sensitive coating composition. Examples of useful auxiliary agents are dispersants such as sodium diocytylsulfosuccinate, sodium dodecylbenzenesulfonate, sodium lauryl sulfate and fatty acid metallic salts; ultraviolet absorbers of the benzophenone, triazole or like type; defoaming agents; fluorescent dyes; coloring dyes, etc.

When desired for lowering the melting temperature of the record layer and improving the record sensitivity thereof, a sensitizer can be admixed with the composition in an amount of about 10 to about 1000 parts by weight, preferably about 50 to about 500 parts by weight, per 100 parts by weight of the color developing material. Examples of useful sensitizers are stearic acid amide, stearic acid methylenebisamide, oleic acid amide, palmitic acid amide, sperm oleic acid amide, coconut fatty acid amide and various other known heat-fusible substances.

Further, when desired, other additives can be incorporated into the composition. Examples of useful additives are waxes such as stearic acid, polyethylene wax, carnauba wax, paraffin wax, calcium stearate and ester wax, and inorganic pigments such as kaolin, clay, talc, calcium carbonate, calcined clay, titanium oxide, kieselguhr, fine granular anhydrous silica and active clay.

As the binder to be used for welding the rear surface of master base sheet 3 (having a heat-sensitive record layer coated thereon) to the surface of second base sheet 5, or likewise third base sheet 7 to the rear surface of the second base sheet to form a binder layer respectively in this invention, a binder consisting of one or more of thermoplastic polymers for which the vicat softening temperature is in the range from 20° C. to 180° C., preferably from 30° C. to 160° C. [ASTM (American Society of Testing Materials) D-1525-70T] is used.

The kind of thermoplastic polymer is not particularly limited insofar as it meets the above-said condition of vicat softening temperature. However, from the point of view of adhesion efficiency, easiness of handling etc., the following are preferred: polyethylene resin, polypropylene resin, polystyrene resin, polyvinylchloride resin, polyvinylidene chloride resin, ethylene-vinyl acetate copolymer resin, butyral resin, polyester resin, polyamide resin, polyacrylic resin, polynitrilic resin, polybutadienic resin, halogenated rubber, urethanic resin, cellulose resin, gelatin or copolymers consisting of monomers of these resins.

Among these polymers, the following are particularly preferred because the base support formed from base sheets which are welded with these does not invite any problem of causing lowering of the heat-sensitive record characteristics for the heat-sensitive record layer: low density polyethylene, atactic polypropylene, ethylenevinyl acetate copolymer, ethylene-acrylic acid copolymer salt, ethylenemethacrylic acid copolymer salt, ethylene-isobutyl acrylate copolymer, ethylene-ethylacrylate copolymer, vinyl acetate-crotonic acid copolymer, vinyl acetate-phthalic anhydride copolymer, styrene-isoprene-styrene block copolymer, styrene-butadiene-styrene block copolymer, styrene-ethylene-butylene-styrene block copolymer, nylon-12, terephthalic acid-1,4-butanediol copolymer, polymethyl acrylate, polymethyl methacrylate, polyethyl acrylate, polyethyl methacrylate, polypropyl acrylate, polypropyl methacrylate, polybutyl acrylate, polybutyl methacrylate, etc.

Also, the binder to be used in this invention may contain one or more adjuvants such as tackifier, liquid or solid plasticizer, softening agent, organic solvent, petroleum resin, pigment, filler, metallic compound, crosslinking agent, wax, surfactant, antioxidant, ultraviolet ray absorbing agent, antidegradation agent etc. in case it is so desired providing that they do not hinder any of the effects expected under the invention.

The welding of the base sheets with the use of the binder consisting of one or more of said thermoplastic polymers in this invention may be carried out by any of the known methods.

Usable as the method are, for example, a method in which the binder in heat-fused state containing neither water nor organic solvent is applied onto the surface of either the master base sheet the reverse surface of which is coated with heat-sensitive coating composition or onto the surface of a second base sheet at the time of assembling the two sheets and they are welded; a method in which there is firstly provided a viscous binder layer in heat-fused state and containing neither water nor organic solvent on the surface of the second base sheet followed by press-welding the rear surface (the surface not having a heat-sensitive record layer thereon) of the master base sheet onto said viscous binder layer; or a method in which the binder either in film-like form or in powdery form is inserted into the inbetween space of the rear surface (the surface not having a heat-sensitive record layer) of the master base sheet and the surface of second base sheet then the binder is fused with heat to thereby weld the two sheets together and to form a binder layer.

Among these methods, the method first mentioned is the most advantageously employed from the view point that the welding of sheets can be stably carried out with high operation efficiency.

The application of the binder in heat-fused state to the surface of a base sheet may be carried out by known coating means such as brush, spray, Mayer bar, screen process printing, kiss-roll coater, direct-roll coater, offset-roll coater, gravure-roll coater, reverse-roll coater, bar coater, blade coater, air-knife coater, curtain coater, die slot coater, extrusion laminator, etc.

The amount of the binder to be applied onto the surface of a base sheet generally lies in the range from 3 to 100 g/m$^2$ on a dry basis, but the greater the amount of the binder applied the better hardness will be given to the heat-sensitive record material obtained.

In the application of the binder to the surface of a base sheet in this invention, it is possible to apply the binder to the relevant part thereof to which the other sheet is to be welded.

In the case of using the binder in film-like form, the vacuum method or a low temperature lamination method in accordance with heat-primer treatment may be employed. And, in the case of using the binder in a powdery form, electrostatic coating method, mesh roll spray-coating method, spray-coating method or screen process printing method may be employed.

The temperature of the binder in fused state on the surface of a base sheet should be varied according to the thickness of the master sheet to which the base sheet is to be welded, it being noted that the master sheet may have a heat-sensitive record layer thereon. Also to be considered is the heat sensitivity of a heat-sensitive record layer formed on the master base sheet to be welded. The temperature is generally controlled to be from 60° C. to 300° C. and preferably from 80° C. to 250° C.

The heat fusion of the binder may be practiced optionally beforehand, afterward or at the time of the welding with the use of steam, electric heat, flame heat blast, heat plate, heat roller, or electromagnetic wave such as infrared radiation, low frequency, high frequency, ultrasonic wave, or laser.

And, in the case where the adhesion of the base sheets is not sufficient, the assembly may be further subjected to heating and cooling or may be treated by electron radiation thereby making the assembly complete.

For the welding of two base sheets into an unitary assembly wherein the binder is used in this invention, it is generally completed by press means such as press roll, nip roll etc. The press condition is varied case by case, but it is generally less 200 kg/cm and preferably less 50 kg/cm.

Additionally, the heat-sensitive record layer of a heat-sensitive record material which has a thick support base is generally so formed as to be placed on the top surface of the assembly. However, when a transparent sheet is used as the master base sheet, it is possible to form this layer on the rear surface of said transparent sheet which is to be welded to a second base sheet. In such case it is, however, necessary to choose a particular kind of binder and a particular welding manner respectively to ensure not invite any color development of the heat-sensitive record layer due to the welding operation.

Also in the case where the transparent sheet is placed on a heat-sensitive record layer, it acts also as an overcoat layer for the heat-sensitive record layer, so that there will be provided a long storable heat-sensitive record material having a thick base support.

PREFERRED EMBODIMENTS OF THE INVENTION

The advantages of this invention are now described in more detail by reference to the following Examples and Comparative Examples, which are provided here for illustrative purposes only, and are not intended to limit the scope of this invention.

Unless otherwise indicated, parts and % signify parts by weight and % by weight respectively.

EXAMPLE 1

A coating composition for the heat-sensitive record layer was prepared in the following manner.

(1) Preparation of mixture A

| (1) Preparation of mixture A | |
|---|---|
| 3-(N—cyclohexyl-N—methylamino)-6-methyl-7-phenylaminofluoran | 5 parts |
| stearic acid amide | 1 part |
| 2% aqueous solution of hydroxyethyl cellulose | 25 parts |

The above mixture was pulverized by a sand mill to a mean particle size of 3 μm.

(2) Preparation of mixture B

| (2) Preparation of mixture B | |
|---|---|
| 4,4'-isopropylidenediphenol | 50 parts |
| stearic acid amide | 10 parts |
| 2% aqueous solution of hydroxyethyl cellulose | 250 parts |

The above mixture was pulverized by a sand mill to a mean particle size of 3 μm.

(3) Formation of record layer 62 parts of the mixture A, 124 parts of the mixture B, 25 parts of fine granular anhydrous silica (trademark SYLOID 244, product of Fuji-Davison Chemical Ltd.), 175 parts of 20% aqueous solution of styrene-maleic anhydride copolymer salt, 5 parts of zinc stearate and 100 parts of water were mixed together and agitated to obtain a heat-sensitive coating composition.

The composition obtained was applied to a non-coated paper sheet weighing 50 g/m$^2$ in an amount of 6 g/m$^2$ based on dry weight and then dried to obtain a heat-sensitive record paper sheet.

(4) Welding of base sheets

The surface of a non-coated paper sheet weighing 120 g/m$^2$ was coated with an ethylene-vinylacetate copolymer binder (trademark ULTRATHENE 760, product of Toyo Soda Manufacturing Co., Ltd., softening point: 43° C.) in an amount of 60 g/m$^2$ based on dry weight by die slot coater while the temperature is kept at 150° C.

Over the binder layer in fused state on the paper sheet, the rear surface of the paper sheet having the heat-sensitive record layer on the opposite surface as obtained in (3) was placed and the two paper sheets were welded by curing the binder to obtain a heat-sensitive record material with a good white external appearance which has a thick base support and weighs 236 g/m$^2$.

The resulting heat-sensitive record material was accompanied with neither background fogginess nor cockles due to shrinkage of the paper sheets and was excellent in dimensional stability.

When the resulting heat-sensitive record material was pressed with a heat plate at 125° C. at 4 kg/cm$^2$, a deep black color image with an excellent durability was obtained.

EXAMPLE 2

The surface of a non-coated paper sheet weighing 100 g/m$^2$ was coated with 25% aqueous solution of ethylene-acrylic acid copolymer sodium salt binder (trademark ZAIKTHENE N, product of Seitetsu Kagaku Co., Ltd., softening point: 40° C.) in an amount of 4 g/m$^2$ based on dry weight by air-knife coater followed by drying. Over the binder layer of the paper sheet, the rear surface of the paper sheet having the heat-sensitive record layer on the opposite surface as obtained in Example 1 was placed and the resulting structure was passed through a nip roll apparatus in which rolls which are heated to 150° C. and cooling rolls are provided while touching said heat-sensitive record layer to the cooling rolls to obtain a press-welded heat-sensitive record material having a thick base support with a good white external appearance.

The resulting heat-sensitive record material was accompanied with neither background fogginess nor cockles due to shrinkage of the paper sheets and was excellent in dimensional stability.

EXAMPLE 3

The heat-sensitive coating composition obtained in Example 1 was applied onto the surface of a transparent polystyrene film having a thickness of 30 μ in an amount of 6 g/m² based on dry weight to obtain a heat-sensitive record film sheet.

5 parts of dicyclohexyl phthalate and 5.3 parts of polymerized rosin were fused at 95° C. and the fused mixture was emulsified in a mixture composed of 28.6 parts of 3.3% aqueous solution of ethanolamine and 0.18 parts of cellulose ether to obtain an emulsion. Then 26 parts of dicyclohexyl phthalate was fused at 95° C., poured into said emulsion and emulsified to obtain an emulsion. This emulsion was mixed with 16 parts of poly (butyl polymethacrylate) emulsion (50% concentration)to be a binder.

The surface of a non-coated paper sheet weighing 100 g/m² was coated with the binder by Mayer bar in an amount of 25 g/m² based on dry weight followed by drying.

Over the binder layer of the paper sheet, the surface of the heat-sensitive record layer placed on the film sheet as above obtained was press applied and welded by a nip roll apparatus to obtain a heat-sensitive record material having a thick base support with a good white external appearance.

The resulting heat-sensitive record material was accompanied with neither background fogginess nor cockles due to shrinkage of the base sheets and was excellent in dimensional stability.

EXAMPLE 4

The heat-sensitive coating composition as obtained in Example 1 was applied onto the surface of a non-coated paper sheet weighing 60 g/m² in an amount of 6 g/m² based on dry weight to obtain a heat-sensitive record paper sheet. The rear surface of this paper sheet was laminated with low density polyethylene resin (softening point: 80° C.) so as to obtain a thickness of 20 μ, over which a non-coated paper sheet weighing 100 g/m² was placed followed by fusing the resin by the impression of a high frequency electrical field with 20 MC and then press-welding the two paper sheets to obtain a heat-sensitive record material having a thick base support with a good white external appearance.

The resulting heat-sensitive record material was accompanied with neither background fogginess nor cockles due to shrinkage of the base sheets and was excellent in dimensional stability.

COMPARATIVE EXAMPLE I

Vinyl acetate group emulsion binder (trademark SAIVINOL GH-100, product of Saiden Chemical Industry Co., Ltd.) was applied to the surface of a non-coated paper sheet weighing 100 g/m² in an amount of 25 g/m² based on dry weight by direct roll coater and immediately after that, over the binder layer of the paper sheet the rear surface of a heat-sensitive record paper sheet having a heat-sensitive record layer on the opposite surface was placed, then press-welded by a nip roll apparatus and dried by dryer to obtain a heat-sensitive record material having a thick base support. (Wet lamination method)

The resulting heat-sensitive record material was of extremely inferior external appearance and was accompanied with remarkable shrinkages and cockles of the base sheets.

COMPARATIVE EXAMPLE 2

Polyurethan group binder (trademark SAIVINOL UF-21, product of Saiden Chemical Industry Co., Ltd.) was applied onto the surface of a non-coated paper sheet weighing 100 g/m² in an axount of 25 g/m² based on dry weight by direct roll coater while drying so as to allow 5% of the solvent to remain in the binder layer as formed.

Over the binder layer of the paper sheet, the rear surface of a heat-sensitive record paper sheet having a heat-sensitive record layer on the opposite surface as obtained in Example 1 was placed and press-welded by a nip roll apparatus to obtain a heat-sensitive record material having a thick base support.

The resulting heat-sensitive record material was of extremely inferior external appearance and was accompanied with remarkable shrinkages and cockles of the base sheets.

What is claimed is:

1. A heat-sensitive record material having a heat-sensitive record layer and a thick base support therefor, said thick base support consisting of a master base sheet, at least one other base sheet and at least one binder layer and weighing at least 150 g/m², said binder layer consisting essentially of at least one thermoplastic polymer for which the vicat softening point is 20° C. to 180° C., and one face of said master base sheet bearing said heat-sensitive record layer and the opposite face of said master base sheet being fixed to the surface of said other base sheet through said binder layer.

2. A heat-sensitive record material according to claim 1, wherein said thermoplastic polymer is low density polyethylene, atactic polypropylene, ethylene-vinyl acetate copolymer, ethylene-acrylic acid copolymer salt, ethylene-methacrylic acid copolymer salt, ethylene-isobutyl acrylate copolymer, ethylene-ethylacrylate copolymer, vinyl acetate-crotonic acid copolymer, vinyl acetate-phthalic anhydride copolymer, styrene-isoprene-styrene block copolymer, styrene-butadiene-styrene block copolymer, styrene-ethylene-butylene-styrene block copolymer, nylon-12, terephthalic acid-1,4-butanediol copolymer, polymethyl acrylate, polymethyl methacrylate, polyethyl acrylate, polyethyl methacrylate, polypropyl acrylate, polypropyl methacrylate, polybutyl acrylate or polybutyl methacrylate.

3. A process for producing a heat-sensitive record material having a heat-sensitive record layer and a thick base support therefor, said thick base support consisting of at least two base sheets and at least one binder layer and weighing at least 150 g/m², which comprises welding the rear surface of a master base sheet having a heat-sensitive record layer on the opposite surface thereof to the surface of second base sheet with a binder consisting essentially of at least one thermoplastic polymer for which the vicat softening point is 20° C. to 180° C. in fused state and curing the binder.

4. A process according to claim 3, wherein a third base sheet is welded to the rear surface of the second base sheet opposite to the surface welded to the rear surface of the master base sheet with a binder consisting essentially of at least one thermoplastic polymer for which the vicat softening point is 20° C. to 180° C. in fused state.

5. A process according to claim 3, wherein said thermoplastic polymer is low density polyethylene, atactic polypropylene, ethylene-vinyl acetate copolymer, ethylene-acrylic acid copolymer salt, ethylene-methacrylic acid copolymer salt, ethylene-isobutyl acrylate copolymer, ethylene-ethylacrylate copolymer, vinyl acetate-crotonic acid copolymer, vinyl acetate-phthalic anhydride copolymer, styrene-isoprene-styrene block copolymer, styrene-butadiene-styrene block copolymer, styrene-ethylene-butylene-styrene block copolymer, nylon-12, terephthalic acid-1,4-butanediol copolymer, polymethyl acrylate, polymethyl methacrylate, polyethyl acrylate, polyethyl methacrylate, polypropyl acrylate, polypropyl methacrylate, polybutyl acrylate or polybutyl methacrylate.

* * * * *